United States Patent [19]

Clinard et al.

[11] 4,337,528

[45] Jun. 29, 1982

[54] MOVING VEHICLE SEISMIC TARGET DETECTOR

[75] Inventors: Glenn G. Clinard; Gail R. Mulhollam, both of Upland, Calif.; Frank J. Volk, Hickory Hills, Ill.

[73] Assignee: The United States of America as represented by the Secretary of the Air Force, Washington, D.C.

[21] Appl. No.: 314,646

[22] Filed: Dec. 13, 1972

[51] Int. Cl.[3] ..... G08B 13/00

[52] U.S. Cl. ..... 367/136; 340/566

[58] Field of Search ..... 340/15, 16 R, 258 D, 340/261, 566; 367/135, 136

[56] References Cited

U.S. PATENT DOCUMENTS

| | | | |
|---|---|---|---|
| 3,686,658 | 8/1972 | Wilt | 367/136 |
| 3,691,549 | 9/1972 | Wilson | 340/261 |
| 3,745,552 | 7/1973 | Wilt | 340/261 |

*Primary Examiner*—Richard A. Farley

*Attorney, Agent, or Firm*—Donald J. Singer

[57] ABSTRACT

Seismic detection of a target is obtained with a geophone detecting earth vibrations caused by the actions of the target. The vibrations are wide band amplified and band-passed filtered with the pass bands being fed to the threshold detectors. The outputs of the threshold detectors are fed to a diode AND logic circuit, the output thereof indicating the presence of a target.

4 Claims, 3 Drawing Figures

MOVING VEHICLE SEISMIC TARGET DETECTOR

BACKGROUND OF THE INVENTION

This invention relates to detection of moving targets, and more particularly to seismic detectors of vehicles.

In our copending application, filed Dec. 13, 1972, entitled, "DUAL MODE TARGET SENSOR," and having Ser. No. 314,644 there is disclosed a combination target detector using both RF and seismic detection and a logic circuit to combine the two systems. The present invention can be used in this combined system or can be used as a purely seismic detector.

SUMMARY OF THE INVENTION

The seismic vehicle detector detects earth vibrations and determines if these vibrations originate from a truck or the like. An approaching truck creates seismic disturbances and a geophone transducer converts these physical disturbances to proportional voltages. The voltages are analyzed according to frequency and threshold.

It is therefore an object of the invention to provide a novel and improved detection system of seismic disturbances.

It is another object to provide a seismic detector that can distinguish a vehicle from a man.

It is another object to provide an accurate seismic detector based on an analysis of pass bands and thresholds.

These and other objects, advantages and features of the invention will become more apparent from the following description taken in connection with the illustrative embodiments in the accompanying drawings.

DETAILED DESCRIPTION OF THE PREFERRED EMBODIMENTS

The present invention is explained using numerical values. However, it is understood that these values are not intended to limit the scope of the invention.

Figure 1:
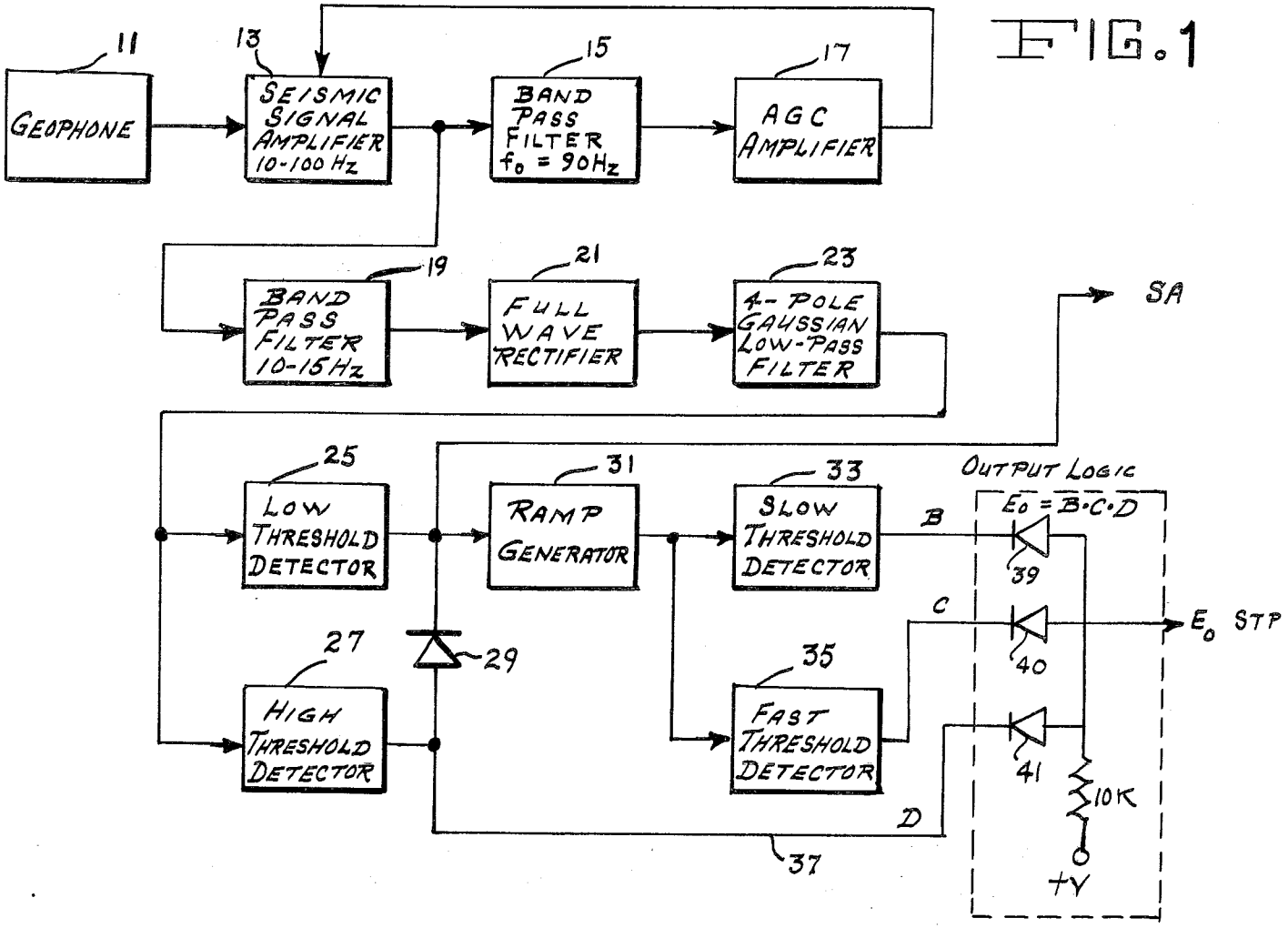
FIG. 1 is a block diagram showing a first embodiment of the invention.

A block diagram of seismic channel is shown in FIG. 1. The function of the seismic channel is to detect earth vibrations and determine if these vibrations originated from the movement of a truck. An approaching truck imparts seismic disturbances to the earth which cause displacements in geophone transducer 11 proportional to the amplitude of the seismic disturbance. Geophone transducer 11 converts displacement velocity to voltage. This voltage or seismic truck signal is amplified by high-gain, low noise audio amplifier 13 with a frequency response from 10 Hz to 100 Hz. The wide band output of amplifier 13 is applied to two circuits. The first is the automatic gain control circuit where the signal passes through band pass filter 15 centered at 90 Hz. The filtered audio is detected and applied to automatic gain control amplifier 17 with an output which may be adjusted from zero volts (minimum gain) to +6 volts (maximum gain). The automatic gain control loop maintains a constant seismic level in the 90 Hz band and effectively nullifies the effects of background noise.

Figure 2:
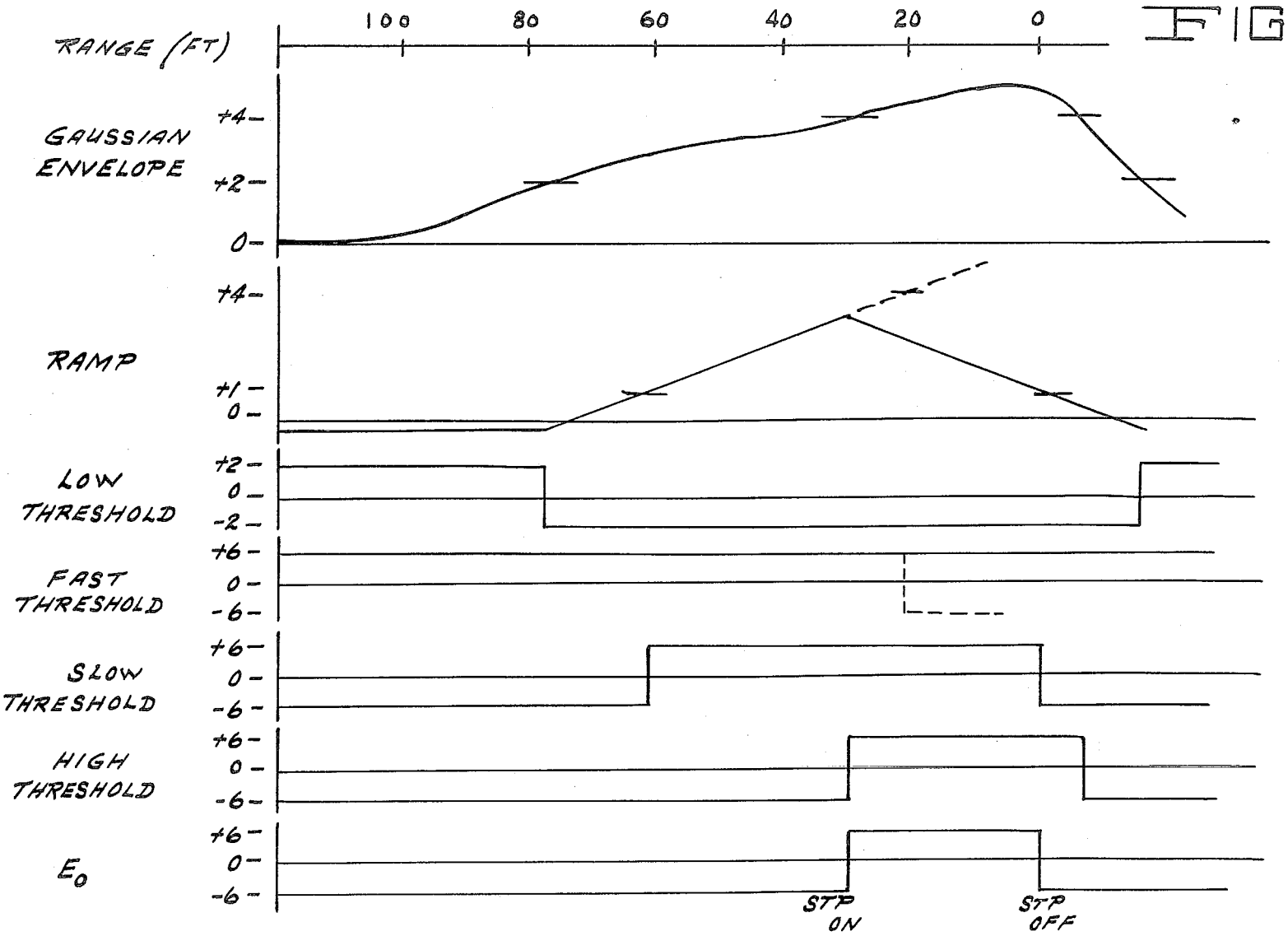
FIG. 2 is a series of graphs useful in the explanation of FIG. 1.

The second circuit to which the seismic truck signal is applied is 10 to 15 Hz bandpass filter 19. This bandpass is desired because most vehicle seismic disturbances appear to occur in this frequency band. The filtered truck audio is full-wave-rectified in rectifier 21 and then detected and filtered by 4-pole Guassian low pass filter 23. The output of Gaussian filter 23 is a typical bell-shaped Gaussian envelope which is shown in FIG. 2 together with the output curves of the subsequent circuits. The Gaussian envelope is applied to low threshold detector 25 and high threshold detector 27. When the Gaussian envelope exceeds the low threshold setting, a ramp generator 31 is enabled. The ramp is used to trigger slow rate threshold detector 33 and fast rate threshold detector 35. When the ramp voltage exceeds the slow gate reference voltage setting the output of slow threshold detector 33 switches from −V to +V. If the lower threshold continues to be exceededd, the ramp will exceed the "fast" ramp voltage and the output of fast threshold detector 35 will switch from +V to −V. If the slow ramp voltage continues to be exceeded, but the fast ramp voltage has not been exceeded when the Gaussian envelope voltage crosses the high threshold setting of high threshold channel 37, a seismic truck present (STP) signal is generated. Diodes 39–41 form an AND logic circuit.

Figure 3:
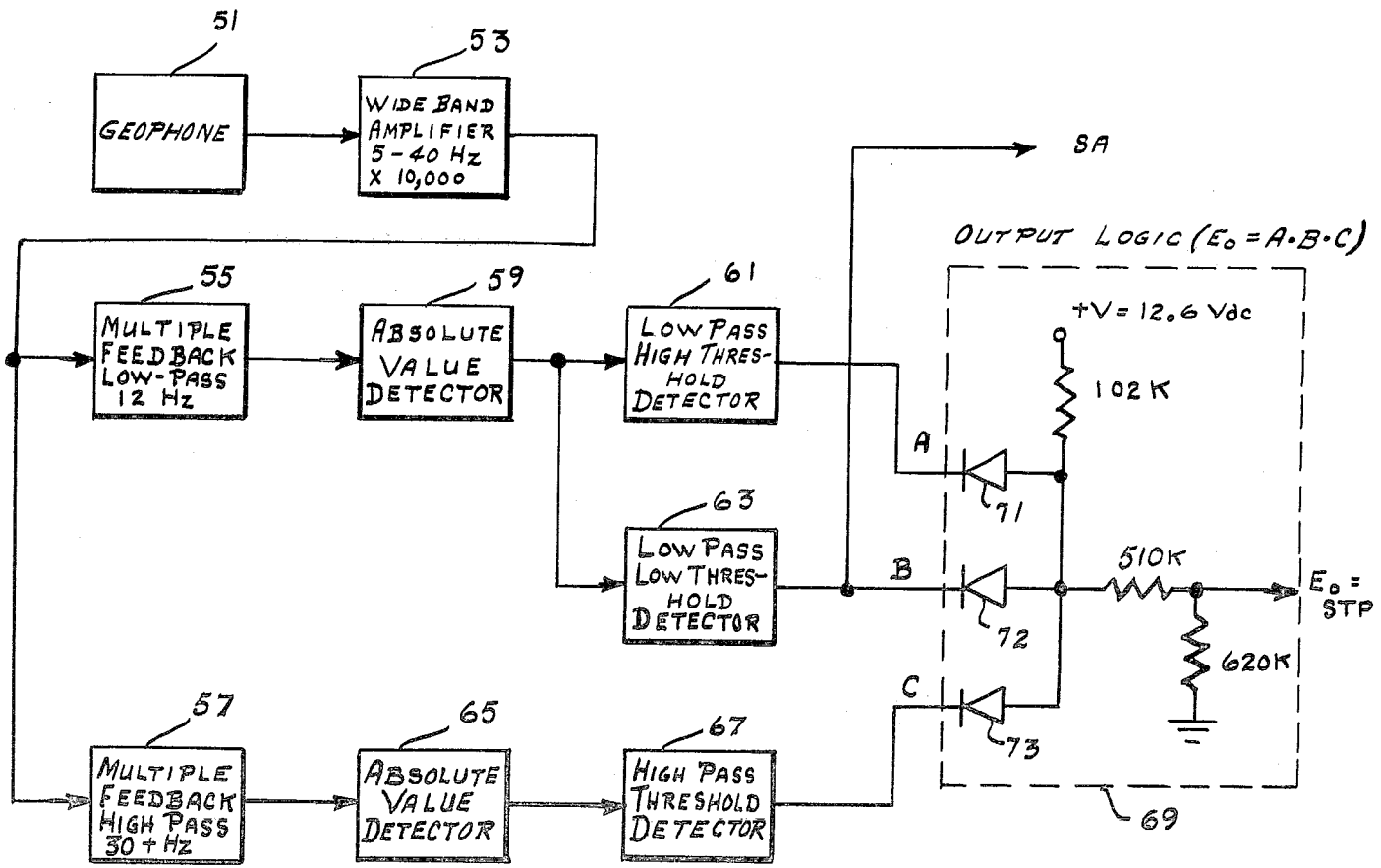
FIG. 3 is a block diagram of a second embodiment of the invention.

A block diagram of a seismic channel which is a second embodiment of the invention is shown in FIG. 3 which also detects earth vibrations and determines if these vibrations originated from the movement of a truck. An approaching truck imparts seismic disturbances to the earth which are converted to voltage by geophone 51. The voltage or seismic truck signal is amplified by wide band amplifier 53 with a nominal gain of 10,000 and a frequency response of 5 to 40 Hz.

The output of wide band amplifier 53 is applied to two narrow band multiple feedback filters 55 and 57. Filter 55 is a low pass, 12 Hz upper cutoff filter. The output of low pass filter 55 is detected by absolute value detector 59 and applied to low pass high threshold detector 61 and low pass low threshold detector 63. The second multiple feedback filter 57 is a high pass, 30 Hz lower cutoff filter. The output of high pass filter 57 is applied to absolute value detector 65 which is applied to high pass threshold detector 67. The outputs of the three threshold detectors 61, 63, and 67 are applied to diode AND logic 69 comprising diodes 71–73. If the threshold setting of low pass low threshold detector 69 is exceeded, the RF channel power is turned on and one input to the diode logic is satisfied. If the low threshold continues to be exceeded and the low pass high threshold is also exceeded as well as the high pass threshold, a seismic truck present (STP) signal is generated.

What is claimed is:

1. A seismic target detector comprising:

a. a geophone;

b. a band pass amplifier fed by the geophone;

c. a first bandpass filter fed by the bandpass amplifier;

d. a full wave rectifier fed by the first bandpass filter;

e. a Gaussian low pass filter fed by the full wave rectifier;

f. a low threshold detector fed by the Gaussian filter;

g. a high threshold detector fed by the Gaussian filter;

h. a ramp generator fed by the low threshold detector and the high threshold detector; and i. logic means by the ramp generator and the high threshold detector producing an output upon the presence of the target.

2. A seismic detector according to claim 1 which further comprises a slow threshold detector and a fast threshold detector in parallel and interposed between the ramp generator and the logic means.

3. A seismic detector according to claim 2 which further comprises an automatic gain control circuit including:

a. a second band pass filter fed by the band pass amplifier; and b. an automatic gain control amplifier fed by the second band pass filter and having a feedback to band pass amplifier.

4. A seismic target detector comprising:

a. a geophone;

b. a wide band amplifier fed by the geophone;

c. a low pass filter fed by the wide band amplifier;

d. a first absolute value detector fed by the low pass filter;

e. a low pass, high threshold detector fed by the first absolute value detector;

f. a low pass, low threshold detector fed by the first absolute value detector;

g. a high pass filter fed by the wide band amplifier;

h. a second absolute value detector fed by the high pass filter;

i. a high pass threshold detector fed by the second absolute value detector; and j. and AND logic circuit fed by the low pass high threshold detector, the low pass low threshold detector, and the high pass threshold detector, the output of the AND logic circuit being indicative of a given target.

* * * * *